United States Patent [19]

Hart

[11] Patent Number: 4,856,120

[45] Date of Patent: Aug. 15, 1989

[54] DIVE MASK

[75] Inventor: Dennis Hart, Newport Beach, Calif.

[73] Assignee: Undersea Industries, Inc., Rancho Dominguez, Calif.

[21] Appl. No.: 147,394

[22] Filed: Jan. 25, 1988

[51] Int. Cl.[4] ..... A61F 9/02

[52] U.S. Cl. ..... 2/428; 2/430

[58] Field of Search ..... 2/428, 429, 430, 426; 128/200.29, 201.23, 201.28

[56] References Cited

U.S. PATENT DOCUMENTS

| | | | |
|---|---|---|---|
| 3,521,626 | 7/1970 | Hashimoto et al. | 128/200.29 X |
| 3,671,976 | 6/1972 | Johnson et al. | 2/430 |
| 3,710,393 | 1/1973 | Douglas | 2/430 |
| 3,895,397 | 7/1975 | Douglas | 2/428 |
| 4,467,797 | 8/1984 | Franke | 128/200.29 X |

FOREIGN PATENT DOCUMENTS

| | | | |
|---|---|---|---|
| 0588149 | 1/1978 | U.S.S.R. | 128/200.29 |

*Primary Examiner*—Peter Nerbun
*Attorney, Agent, or Firm*—Leonard Tachner

[57] ABSTRACT

A dive mask of the purge valve-type that comprises a deflector affixed to the lower front surface thereof for channeling air bubbles expelled during purging to the sides of the mask to avoid interference with the diver's vision. A plurality of vertical and horizontal spacers are also provided to assure the availability of a free flow air channel between the deflector and the remaining structure of the mask. In the preferred embodiment disclosed herein, the deflector is ornamentally shaped to enhance the styling and physical appearance of the overall mask structure.

6 Claims, 4 Drawing Sheets

DIVE MASK

FIELD OF THE INVENTION

The present invention relates generally to underwater accessories and more specifically, to a purge-type dive mask in which the purge valve is covered by a deflector for directing air bubbles to the sides of the mask to prevent interference with the diver's vision.

PRIOR ART

The use of dive masks by scuba divers and snorkel divers for providing an air pocket in front of the eyes of the diver to improve underwater vision is well-known in the art. However, a common problem associated with such dive masks is that if they are not tight fitting or if there is any movement of the mask about the surface of the face, water leaks into the air bubble in front of the eyes thereby possibly obscuring vision or at least otherwise reducing the comfort level of the diver. Accordingly, in recent years dive masks have been provided with purge valves which permit the diver to purge the mask of water by simply exhaling through his nose thereby creating a positive pressure which forces any water that has leaked into the mask out through the purge valve. Unfortunately, most purge valves for dive masks are located immedately in front of the nose region at the base of the view member where water has gathered. This position is the most preferred because it increases the likelihood of a successful purging operation and minimizes interference with vision that a purge valve located in another portion of the mask might incur. Thus, locating the purge valve in the front of the mask immediately adjacent the nose is advantageous from certain standpoints, however, it is also disadvantageous from the standpoint of vision obscuration due to the escape of air bubbles during the purging operation. More specifically, when exhaled air from the user's nose escapes through the purge valve with the sea water being purged, the air bubbles will of course immediately begin to travel towards the surface of the water. In most cases, with the diver in an upright, substantially vertical configuration, such air bubbles will pass immediately in front of the dive mask thereby at least momentarily obscuring the vision of the diver. Although such vision obscuration may occur only briefly, if frequent purging of the mask is necessary, at the very least it can become a considerable nuisance. In addition, there are situations in which the diver's vision must not be interrupted even momentarily such as for example, in underwater photography where it is absolutely necessary for the diver for have a constant, clear visual path along which to see the image he is photographing. There is therefore a need for a dive mask of the purge valve-type which, while permitting the purge valve to be located in its most preferred position immediately in front of the nose at the base of the mask, avoids even momentary passage of air bubbles through the visual path of the diver.

SUMMARY OF THE INVENTION

The present invention solves the aforementioned long-felt need by providing a dive mask of the purge valve type that provides a novel deflector that is affixed to the mask in juxtaposition to the purge valve along the exterior surface thereof and which provides a path for the purged water and air bubbles intermixed therewith to the sides of the mask where the air bubbles may rise to the surface without passing in front of the diver's path of vision. Therefore, the improved dive mask of the present invention preserves all of the aforementioned advantages of a purge valve-type dive mask while eliminating or at least substantially reducing the aforementioned disadvantage of frequent vision obscuration. In fact, the invention herein described in its preferred embodiment, utilizes a novel configuration which permits implementation with a front view member as well as two side view members to even further improve the diver's overall visual opportunities by permitting the diver to exploit his inherent peripheral vision as well. The deflector of the present invention in the preferred embodiment described herein comprises a thin, plastic member shaped to conform to the curvature of the view frame and support frame to which it is connected. It is provided with a frame cover which is designed to fully overlap and enclose the purge valve and an integral arch member which is designed to channel the flow of air bubbles along the bottom surface of the mask towards the side edges thereof. A plurality of vertical and horizontal spacers are also provided to assure the availability of a free flow air channel between the deflector and the remaining structure of the mask. In the preferred embodiment disclosed herein, the deflector is ornamentally shaped to enhance the styling and physical appearance of the overall mask structure.

OBJECTS OF THE INVENTION

It is therefore a principal object of the present invention to provide an improved dive mask of the purge valve-type and having a deflector which overlaps the purge valve and channels the air bubbles to the sides of the mask to prevent even temporary interference with the vision of the diver.

It is an additional object of the present invention to provide an improved dive mask of the purge valve-type and configured to receive a deflector adapted to overlie the exterior of the purge valve for channeling air to the sides of the mask and wherein the deflector enhances the styling and appearance of the combined structure.

It is still an additional object of the present invention to provide an improved dive mask of the type having a purge valve at the base of the view member immediately in front of the nose of the diver and means for channeling the air expelled through the valve to the sides of the mask to preclude vision obscuration otherwise created by bubbles exiting the purge valve and rising towards the surface through the viewing path of the diver.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DESCRIPTION OF A PREFERRED EMBODIMENT

Figure 1:
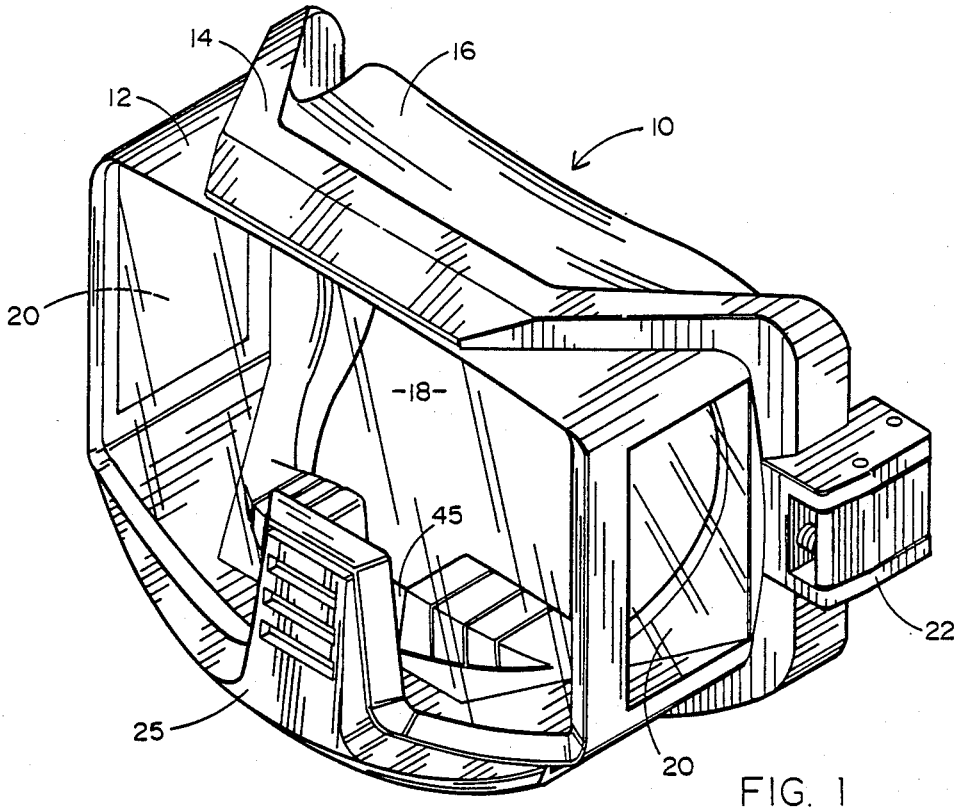
FIG. 1 is an isometric view of the present invention shown fully assembled.

Referring to the figures it will be seen that the improved dive mask 10 of the present invention comprises a view frame 12, a support frame 14, a user interface member 16, a front view member 18 and two side view members 20. The view frame 12 is of a generally rectangular configuration except for the bottom portion thereof which is of an arched configuration. View frame 12 provides the principal support structure for retaining the front view member 18 and the two side view members 20 each of which is preferably made of a transparent, optically neutral such as tempered glass material. The support frame 14 is of a substantially clam-shaped configuration which is affixed to the exterior surface of the view frame and serves the dual function of providing a strap interface and also securing the user interface member 16, the leading edge of which is retained between support frame 14 and view frame 12 around the entire periphery of the mask. Both view frame 12 and support frame 14 are preferably made of a hard, inflexible but damage resistant material. On the other hand, user interface member 16 is preferably made of a soft, flexible, rubber-like material having a soft, smooth texture for providing a comfortable compressive interface with the face of the user. The lower portion of user interface member 16 is preferably provided with a pair of nose pieces 44 forming a nose recess 45 therebetween for accommodating this feature of the diver's face.

On each side of the support frame 14 there is positioned an integral strap interface member 22 which provides a strap adjustment bracket 21, a spring 23, a strap retention pin 27 and a fulcrum pin 29. Those having skill in the art to which the present invention pertains wall understand from FIGS. 1 and 2 that the strap interface member 22 receives one end of a strap (not shown) that is adjustably secured around the back of the diver's head to secure the dive mask 10 to the face of the diver in compressive, water-tight engagement. The strap adjustment bracket 21 is rotatable about fulcrum pin 29 when spring 23 is compressed thereby to permit adjustment of the folded end of a strap about strap retention pin 27.

Figure 2:
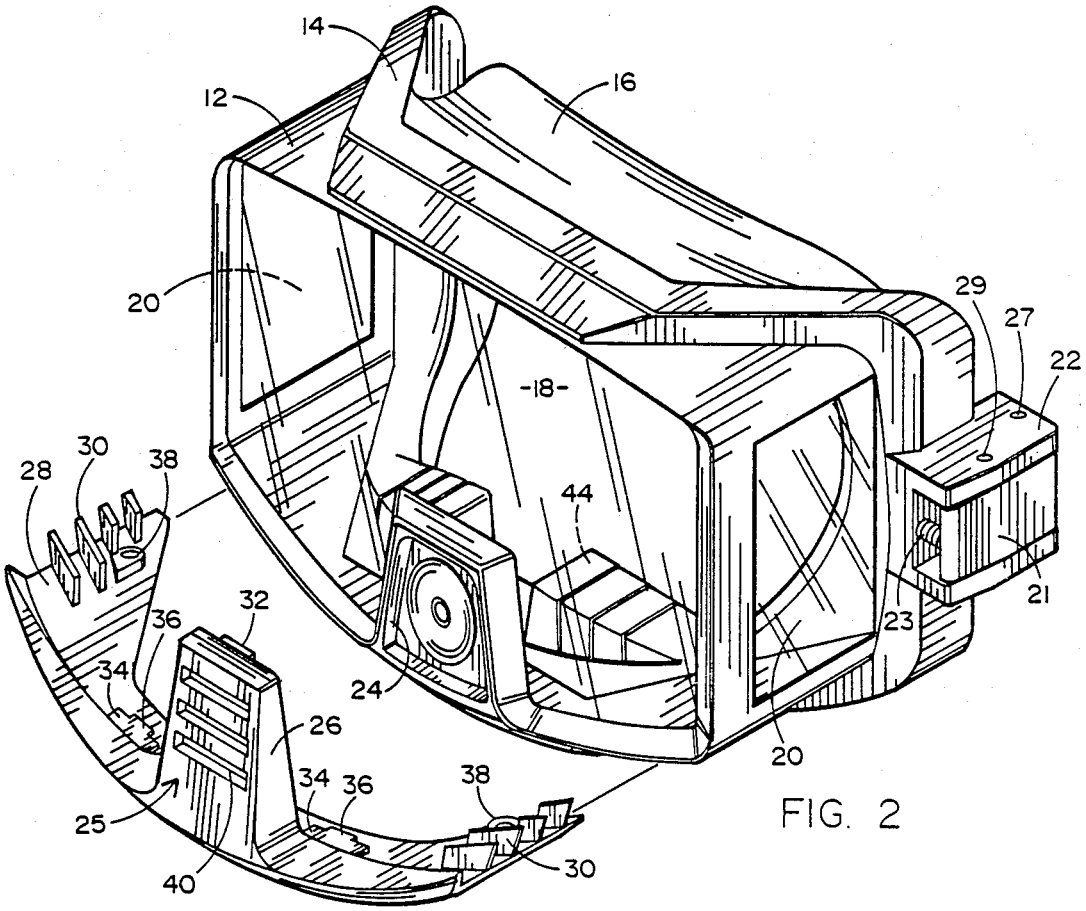
FIG. 2 is an isometric view of the present invention similar to that of FIG. 1 but showing the deflector detached from the mask.
Figure 6:
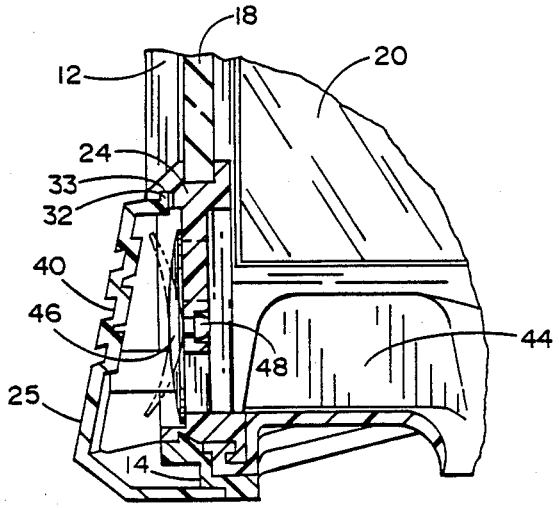
FIG. 6 is an enlarged cross-sectional view of a portion of the mask adjacent the deflector and taken within the circle labeled FIG. 6 in FIG. 5.
Figure 7:
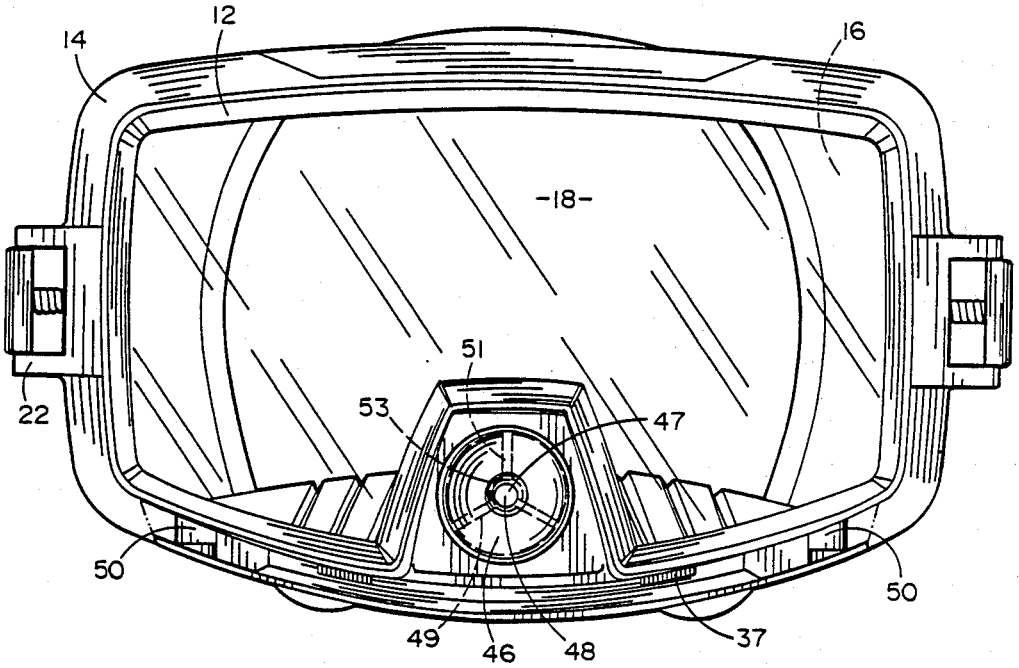
FIG. 7 is a front view of the mask of the present invention with the deflector removed.
Figure 8:
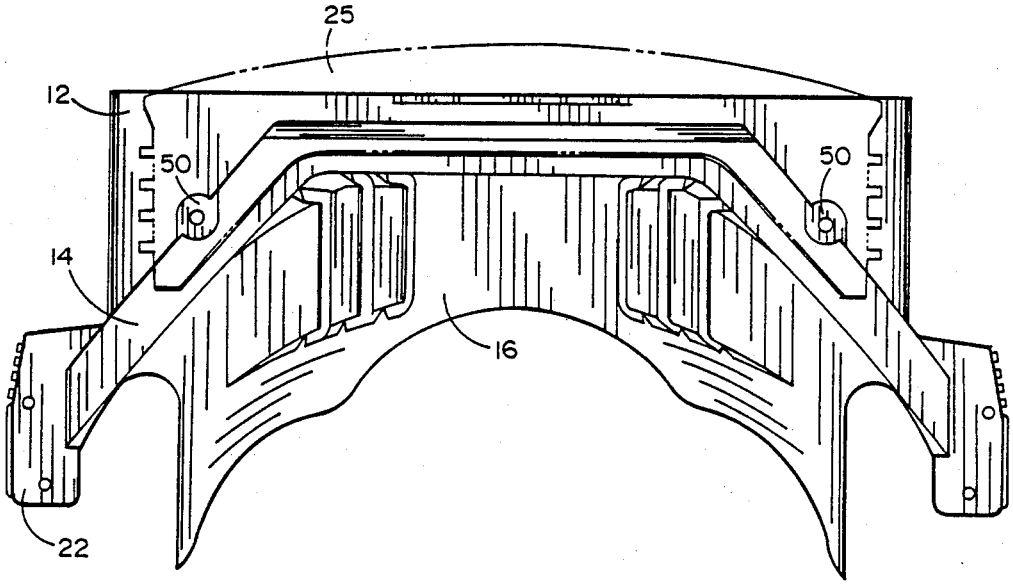
FIG. 8 is a bottom view of the mask of the invention with the reflector shown in phantom.

As seen best in FIGS. 2, 6 and 7, the dive mask 10 of the present invention is provided with a purge valve frame 24 which is of a generally trapezoidal configuration and is positioned at the lower center portion of front view member 18 immediately in front of the nose of the diver. The purge valve comprises a flexible rubber-like valve cover 46 having an elongated valve stem 48 extending through an aperture 47 formed in a valve cover support 49 which includes three equally spaced radial members 51 extending from a centrally positioned ring 53. As seen best in FIG. 6, the valve cover 46 is designed to flex outwardly to permit air flow from the interior of the mask to the exterior of the mask upon nasal exhalation by the diver. On the other hand, the valve cover 46 does not permit any fluid flow into the diver's mask 10 thereby permitting purging of the water in the mask without allowing any leakage into the mask.

It will be evident to those having skill in the art to which the present invention pertains, that without any additional structure the purge valve of the present invention would result in the passage of air bubbles immediately in front of the front view member 18 each time the diver purges the water in the mask by exhaling through his nose. Such air bubbles obscure the vision of the diver each time a purging event occurs. To preclude this disadvantage the novel structure of the present invention provides a deflector 25 which utilizes a frame cover 26 to overlap and enclose the purge valve frame 24 of the remaining structure of the mask 10. Deflector 25 also provides an arch member 28 which is designed to be positioned below the bottom arched surface of the view frame 12 and support frame 14. A plurality of vertical spacers 30 and a pair of horizontal spacers 34 structurally support the arch member and assure that there will be an air channel 31 between the arch member and the lower surface of mask 10 that terminates at the side of the mask. Frame cover 26 is provided with an insert 32 which is designed to be received in a space or recess 33 seen best in FIG. 6. Similarly, horizontal spacers 34 are provided with inserts 36 designed to be received by spacer recesses 37 seen best in FIG. 7. This combination of inserts and spacer recesses assures a stable engagement between the deflector 25 and the remaining structure of the mask 10 when the deflector is secured to the mask in the manner to be described hereinafter.

Figure 3:
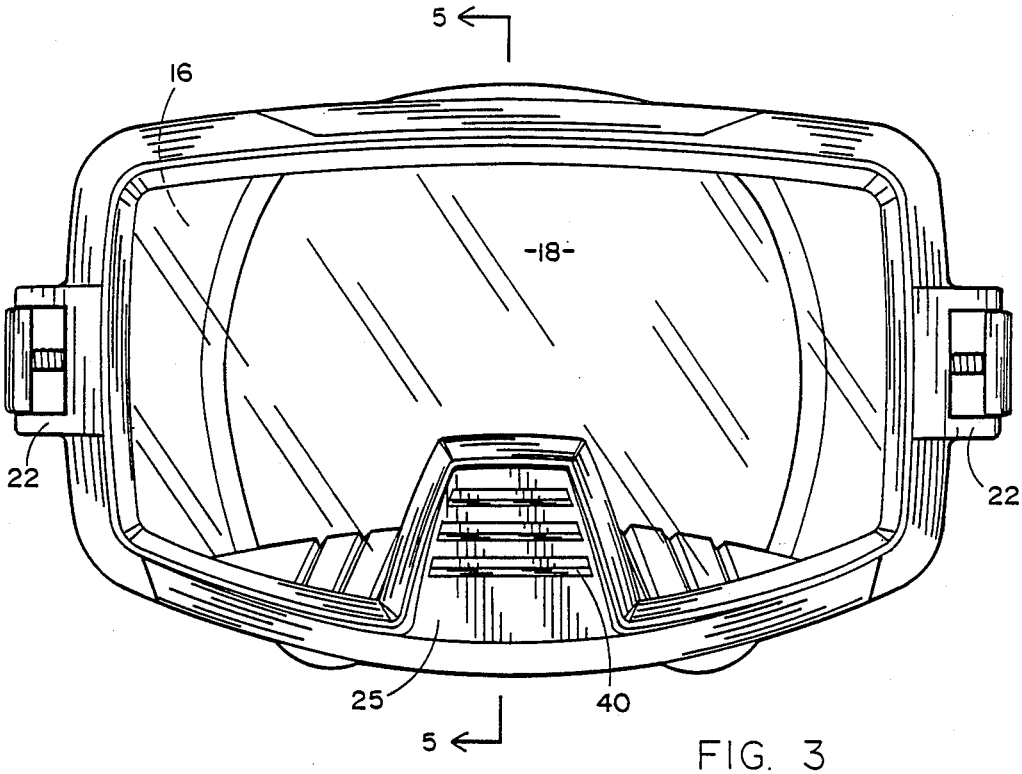
FIG. 3 is a front view of the invention.
Figure 4:
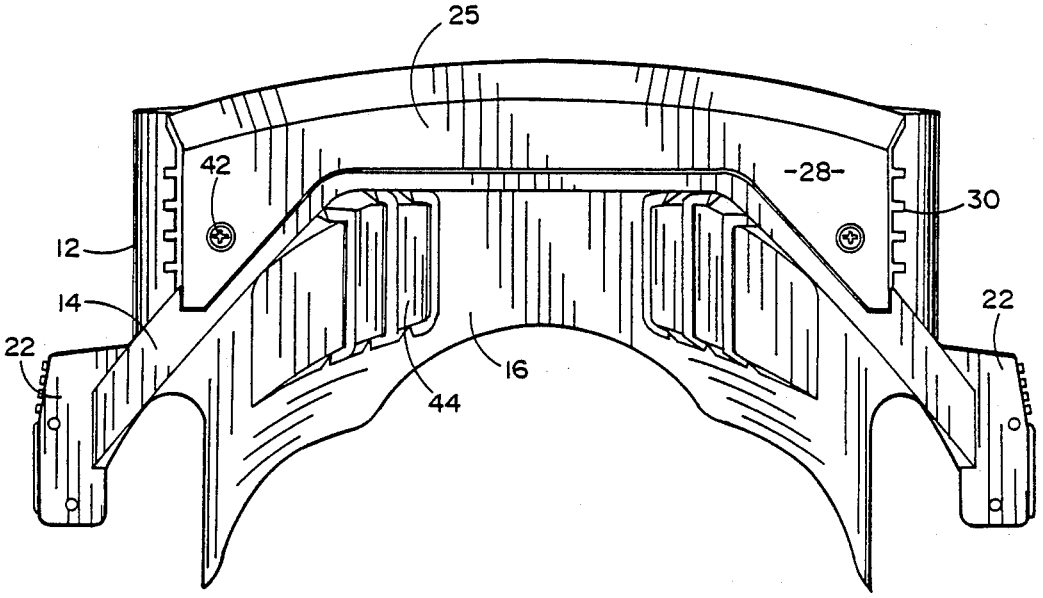
FIG. 4 is a bottom view of the invention.
Figure 5:
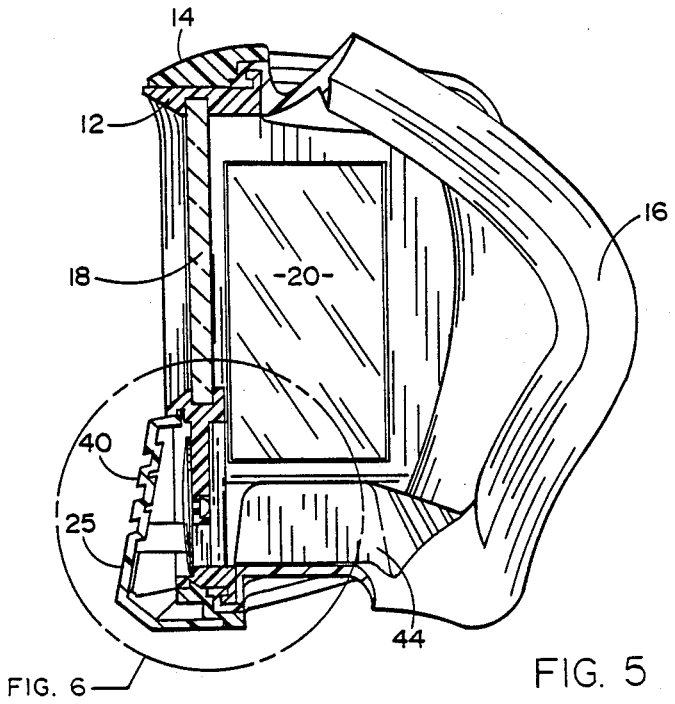
FIG. 5 is a cross-sectional view of the invention taken along lines 5—5 of FIG. 3.

More specifically, as seen in FIG. 2, the deflector 25 is provided with a pair of apertured fastening members 38. In addition, the support frame 14 along the bottom of the mask 10 is provided with a pair of threaded members 50 designed to align with the apertures in fastening members 38 so that a pair of screws 42 may be used in the manner shown in FIG. 4 to securely engage the deflector 25 to the rest of the mask structure. The frame cover 26 of deflector 25 may optionally include a plurality of ornamental horizontal ridges 40 seen best in FIGS. 2 and 3 in front view and in FIGS. 5 and 6 in side cross-sectional view. Although ornamental ridges 40 serve primarily an appearance enhancement function, they may also serve to increase the structural integrity of the frame cover portion of deflector 25.

It will now be understood that what has been described herein comprises a novel, improved dive mask of the purge valve-type wherein water inadvertently collected within the mask may be expelled by the diver simply by exhaling through the nose to increase the air pressure within the mask forcing such water out through the purge valve. However, in the present invention a substantial disadvantage of the prior art, namely, a view interfering effect of air bubbles rising past the front view member, is obviated. This is accomplished by providing the dive mask with a unique deflector which is attached to the mask to overlap and fully enclose the purge valve and direct the exiting water and air through a channel provided between an arched member of trhe deflector and the lower surface of the mask thereby forcing the air bubbles to the side of the mask where they may be expelled without passing through the viewing path of the diver.

Those having skill in the art to which the present invention pertains will now, as a result of the disclosure herein, perceive various modifications and additions which may be made to the invention. By way of example, the specific shape and method of interfacing the novel deflector of the present invention with the remaining portions of the mask may be readily modified to accommodate different mask geometries and structures while still providing the principal advantage of redirecting expelled air to the sides of the mask to avoid the interference of the diver's viewing path in the manner described. Accordingly, all such additions and modifications are deemed to be within the scope of the invention which is to be limited only by the claims appended hereto.

I claim:

1. An improved dive mask of the type having a frame circumscribing a diver's nose and eyes to define an interior space, a front transparent viewing member and a purge valve for expelling water from within the mask by exhalation of air through the diver's nose; the improvement comprising:

a deflector affixed to said frame in overlapping engagement with said purge valve, said deflector being substantially T-shaped in contour, said T-shaped deflector defining a central leg member forming a purge valve overlapping member having an interior wall adjacent said purge valve for intercepting and downwardly deflecting said expelled water and air, and a transverse elongated member integrally formed with said purge valve overlapping member in one piece formation for providing at least one channel defined by a space formed between an interior surface of said transverse elongated member and an exterior surface of said frame for routing expelled water and air transversely to the side of the mask for precluding interference with the diver's vision through said viewing member.

2. The improvement recited in claim 1 wherein said deflector comprises a plurality of spacers for structurally supporting at least a portion of said deflector in spaced relation to said frame.

3. The improvement recited in claim 1 further comprising means on said frame and said deflector for affixing said deflector to said frame.

4. The improvement recited in claim 1 wherein said integral member of said deflector and said adjacent frame portion are both arched.

5. The improvement recited in claim 1 wherein said channel terminates adjacent the side of said mask.

6. The improvement recited in claim 1 wherein said deflector provides at least two of said channels, each such channel being routed to an opposing side of said mask.

* * * * *